US009279254B2

(12) United States Patent
Vincent et al.

(10) Patent No.: US 9,279,254 B2
(45) Date of Patent: Mar. 8, 2016

(54) ANCHOR ARRANGEMENT

(71) Applicant: CCL STRESSING INTERNATIONAL LIMITED, West Yorkshire (GB)

(72) Inventors: Peter Vincent, West Yorkshire (GB); Carol Hayek, Potomac, MD (US)

(73) Assignee: CCL Stressing International Limited, West Yorkshire (GB)

( * ) Notice: Subject to any disclaimer, the term of this patent is extended or adjusted under 35 U.S.C. 154(b) by 0 days.

(21) Appl. No.: 14/431,287

(22) PCT Filed: Oct. 17, 2013

(86) PCT No.: PCT/GB2013/052717

§ 371 (c)(1),
(2) Date: Mar. 25, 2015

(87) PCT Pub. No.: WO2014/060764

PCT Pub. Date: Apr. 24, 2014

(65) Prior Publication Data

US 2015/0247322 A1 Sep. 3, 2015

(30) Foreign Application Priority Data

Oct. 18, 2012 (GB) ..... 1218755.5

(51) Int. Cl.
*E04B 1/00* (2006.01)
*E04G 21/00* (2006.01)
(Continued)

(52) U.S. Cl.
CPC . *E04C 5/12* (2013.01); *E04C 5/076* (2013.01); *E04C 5/125* (2013.01); *E04C 5/161* (2013.01); *E04C 5/127* (2013.01); *E04C 5/16* (2013.01); *Y10T 29/49632* (2015.01)

(58) Field of Classification Search
CPC ..... E04C 5/12; E04C 5/161; E04C 5/16; E04C 5/122; E04C 5/127
USPC ..... 52/223.13, 223.1, 223.14, 296, 745.21; 29/897.34
See application file for complete search history.

(56) References Cited

U.S. PATENT DOCUMENTS 3,559,275 A * 2/1971 Slater ..... E04C 5/12 164/108
3,588,045 A * 6/1971 Stubbs ..... E04G 21/121 254/29 A (Continued)

FOREIGN PATENT DOCUMENTS

CN 102493661 A 6/2012
DE 951764 C 10/1956

(Continued)

OTHER PUBLICATIONS

International Preliminary Report on Patentability for PCT/GB2013/052717 dated Apr. 21, 2015.

(Continued)

*Primary Examiner* — Chi Q Nguyen
(74) *Attorney, Agent, or Firm* — Daniel A. Tanner, III; Prass LLP

(57) ABSTRACT

Systems and methods are provided for securing ends of tendons in an anchor housing. Tendons having open or expanded sections are inserted through a cylindrical surface of the anchor housing. The tendons are secured in the anchor housing by grout which cooperates with the open or expanded sections and irregularities formed on the interior surface of the anchor housing.

14 Claims, 6 Drawing Sheets

(51) Int. Cl.

| | |
|---|---|
| ***E04G 23/00*** | (2006.01) |
| ***E04C 5/12*** | (2006.01) |
| ***E04C 5/07*** | (2006.01) |
| *E04C 5/16* | (2006.01) |

(56) References Cited

U.S. PATENT DOCUMENTS

| | | | | | |
|---|---|---|---|---|---|
| 3,605,361 | A * | 9/1971 | Howlett et al. | E04C 5/122 | 24/122.6 |
| 3,647,184 | A * | 3/1972 | Vanderhurst | E04G 21/121 | 254/29 A |
| 3,658,290 | A * | 4/1972 | Peters | F16K 1/38 | 137/872 |
| 3,833,706 | A * | 9/1974 | Edwards | E04C 5/12 | 249/190 |
| 3,844,697 | A * | 10/1974 | Edwards | E04C 5/12 | 249/217 |
| 4,043,133 | A * | 8/1977 | Yegge | E02D 5/58 | 405/239 |
| 4,237,942 | A | 12/1980 | Dietrich | | |
| 4,469,756 | A * | 9/1984 | Jungwirth | E04C 5/125 | 140/105 |
| 4,627,212 | A | 12/1986 | Yee | | |
| 4,773,247 | A * | 9/1988 | Zols | E04C 5/125 | 29/461 |
| 4,915,544 | A * | 4/1990 | Lin | E02D 5/385 | 405/239 |
| 5,344,256 | A * | 9/1994 | Hedrick | D07B 5/005 | 29/461 |
| 5,699,572 | A * | 12/1997 | Castle | E21D 11/006 | 140/123 |
| 5,701,707 | A * | 12/1997 | Sorkin | E04C 5/12 | 52/223.13 |
| 6,785,958 | B1 * | 9/2004 | Saito | B60R 16/0222 | 140/118 |
| 7,056,463 | B2 * | 6/2006 | Ohta | B28B 23/043 | 156/162 |
| 7,563,075 | B2 | 7/2009 | Wenckebach et al. | | |
| 2005/0210782 | A1 * | 9/2005 | Kadotani | E04C 5/122 | 52/223.13 |
| 2012/0297703 | A1 * | 11/2012 | Sentry | E04C 5/127 | 52/166 |

FOREIGN PATENT DOCUMENTS

| | | | |
|---|---|---|---|
| DE | 4437104 | C1 | 11/1995 |
| EP | 0935034 | A1 | 8/1999 |
| FR | 1551162 | A | 12/1968 |
| GB | 1419997 | A | 1/1976 |
| GB | 2192210 | A | 1/1989 |
| GB | 2267104 | A | 11/1993 |
| JP | 62-46716 | U | 3/1987 |
| JP | 11-117456 | A | 4/1999 |

OTHER PUBLICATIONS

Search Report for GB Patent Application No. 1218755.5 dated Jul. 31, 2014.

International Search Report for PCT/GB2013/052717 mailed Jan. 27, 2014.

Written Opinion for PCT/GB2013/052717 mailed Jan. 27, 2014.

* cited by examiner

ANCHOR ARRANGEMENT

The present invention relates to an anchor arrangement, an anchor arrangement including a hollow anchor, a structure including a hollow anchor, a method of forming an anchor and an anchor suitable for use in pre-stressing a concrete structure.

The present invention is particularly, although not exclusively, applicable to an anchorage arrangement in which the anchor is not accessible after a structure has been formed.

DE4437104 includes wire anchor strands embedded in an anchorage of hardened grouting. The strands in the anchorage include a bellied part enclosed in a plastic tube. The exterior surface of the anchorage is indented or ribbed or shouldered to assist in retaining the anchorage within the surrounding concrete.

The bellied part is wide and accordingly can only be inserted from the side of the structure towards which the anchorage is located. Furthermore, the grout within the anchorage is only resisted from coming out of the anchorage by abutment with an end face of the anchor.

It is an object of the present invention to attempt to overcome at least some of the above or other disadvantages.

According to a first aspect of the present invention an anchorage arrangement includes a hollow anchor arranged, in use, to be located to a first side of a structure and a plurality of multi-wired tendons in which the adjacent wires are in contact with each other along the majority of the extent of the tendons, and in which one end region of the tendons are arranged, in use, to be located in the hollow anchor, at least some of the end regions of the tendons including at least one expanded section in which the wires of a length of a tendon are separated from each other such that they do not contact each other, the tendons being arranged, in use, to be inserted into the hollow anchor to locate the expanded sections in the hollow anchor from a second side of the structure opposed to the first side.

The present invention also includes a structure including a hollow anchor as herein referred to.

According to another aspect of the present invention a method of forming an anchorage comprises locating a hollow anchor at a first side of a side structure and inserting a plurality of multi-wires tendons through the structure from a second side of the structure opposed to the first side such that end regions of the tendons are located in the hollow anchor, adjacent wires on the tendons being in contact with each other along the majority of the extent of the tendons and with at least some of the end regions of the tendons including at least one expanded section in which the wires over a length of the tendon are separated from each other such that they do not contact each other with the expanded sections being located in the hollow anchor.

According to another aspect of the present invention an anchor suitable for use in a pre-stressed concrete anchorage includes a hollow interior into which tendons to be pre-stressed are arranged to be inserted and secured therein by grout with the interior surface of the hollow interior including irregularities with which, in use, the grout is arranged to cooperate to assist in retaining the tendons.

According to a further aspect of the present invention an anchor arrangement includes a hollow anchor arranged, in use, to be located at a side of a structure and a plurality of multi-wired tendons in which adjacent wires are in contact with each other along the majority of the extend of the tendons and in which one end region of the tendons is arranged, in use, to be located in the hollow anchor, at least some have said end regions of the tendons including a plurality of spaced expanded sections in which the wires over a length of a tendon are separated from each other such that they do not contact each other.

The present invention includes any combination of the herein referred to features or limitations.

The present invention may be carried into practice in various ways but one embodiment will now be described by way of example and with reference to the accompanying drawings in which.

Figure 1:
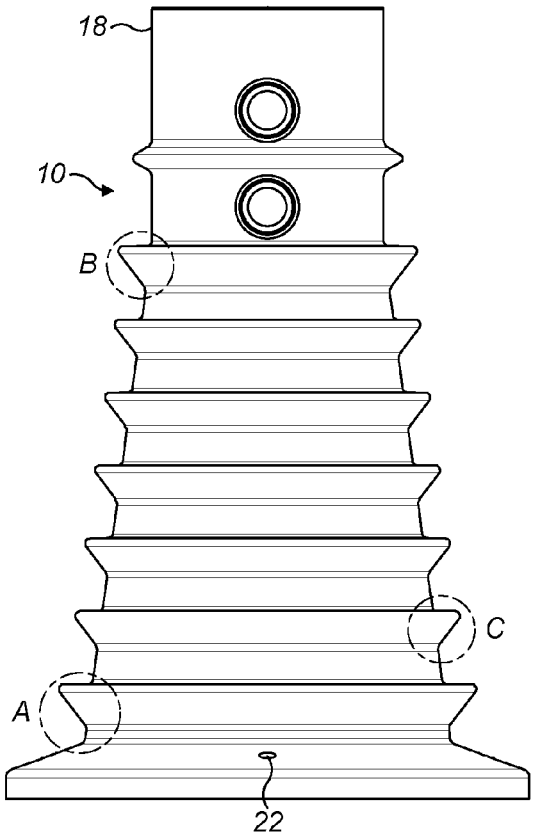
FIG. 1 is a side view of part of an anchor housing 10.
Figure 2:
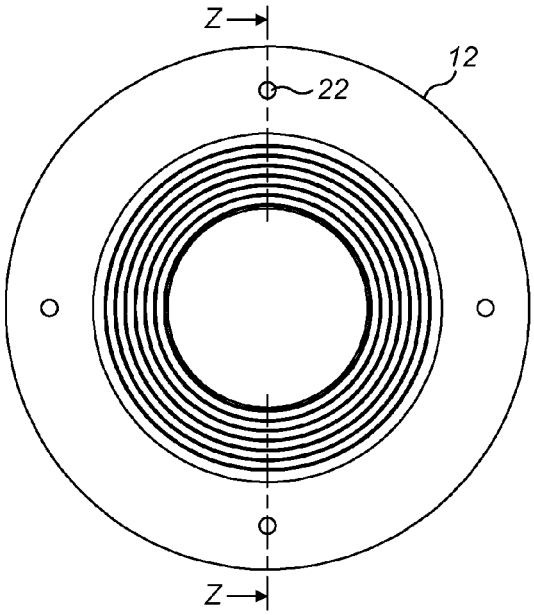
FIG. 2 is a plan view of FIG. 1.
Figure 4:
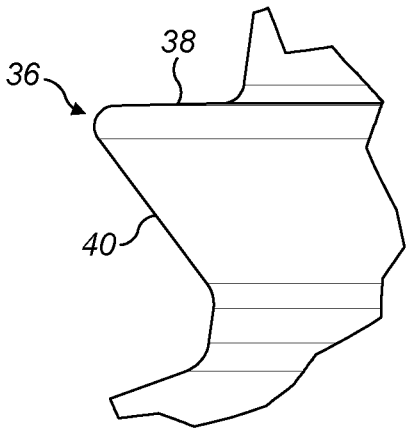
Figure 5:
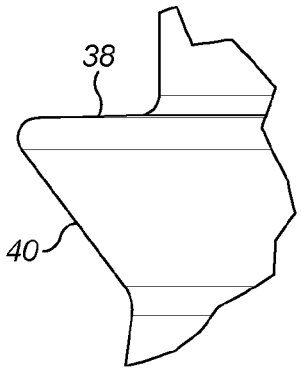
Figure 6:
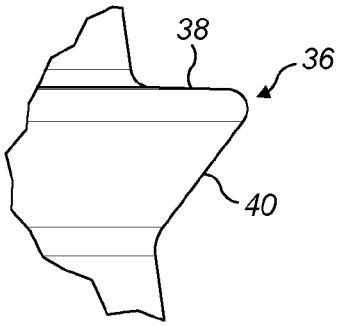

FIGS. 4, 5 and 6 on detailed views of parts A, B and C respectively of FIG. 1

Figure 3:
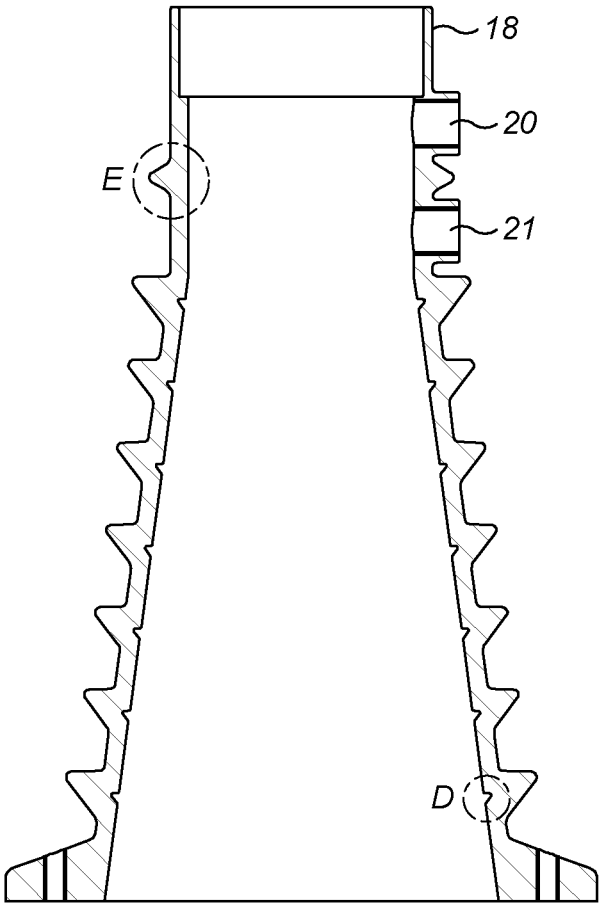
FIG. 3 is a sectional view of FIG. 2 taken on the line z-z of FIG. 2.
Figure 7:
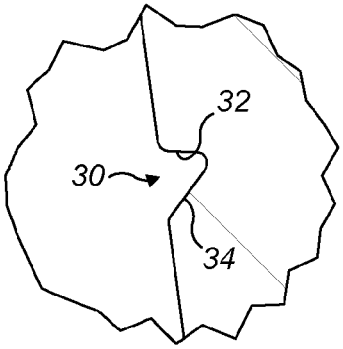
Figure 8:
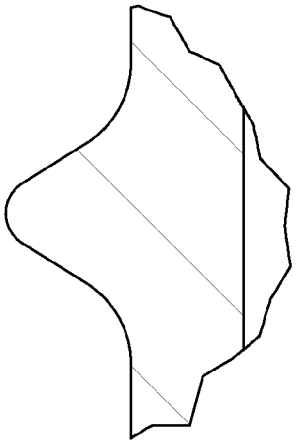
Figure 10:
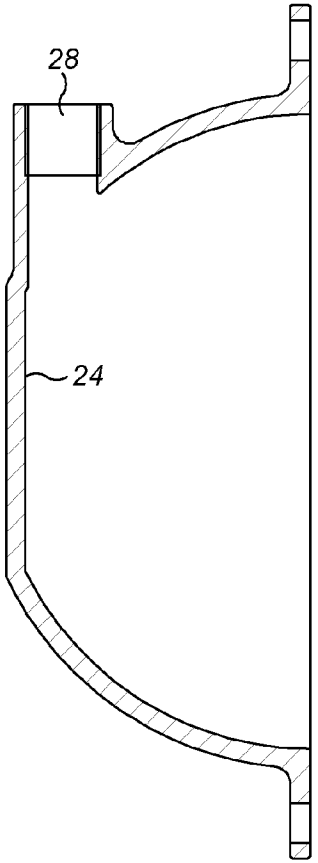
Figure 9:
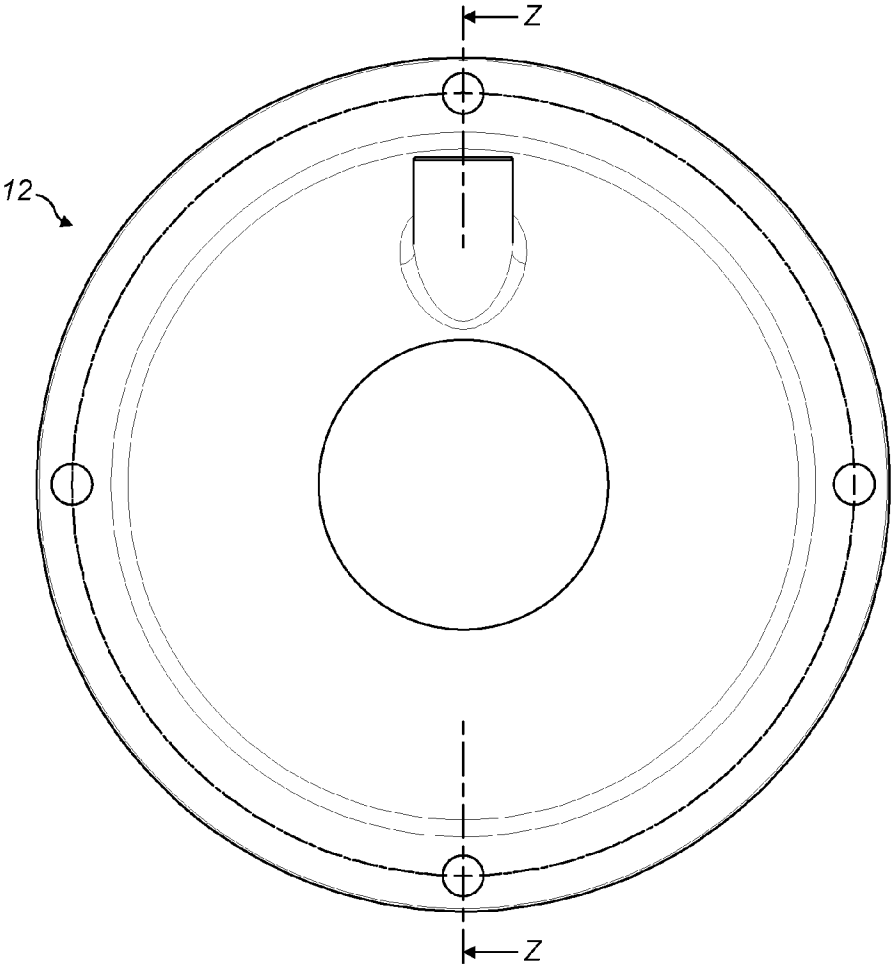
Figure 11:
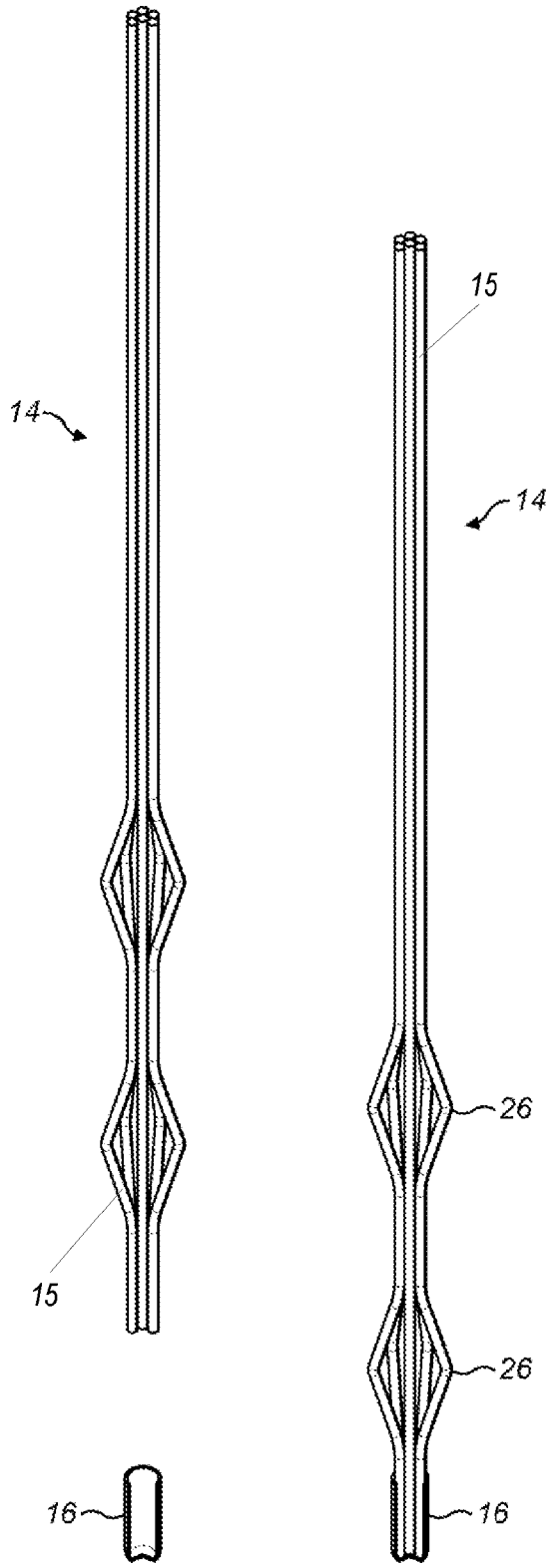
Figure 12:
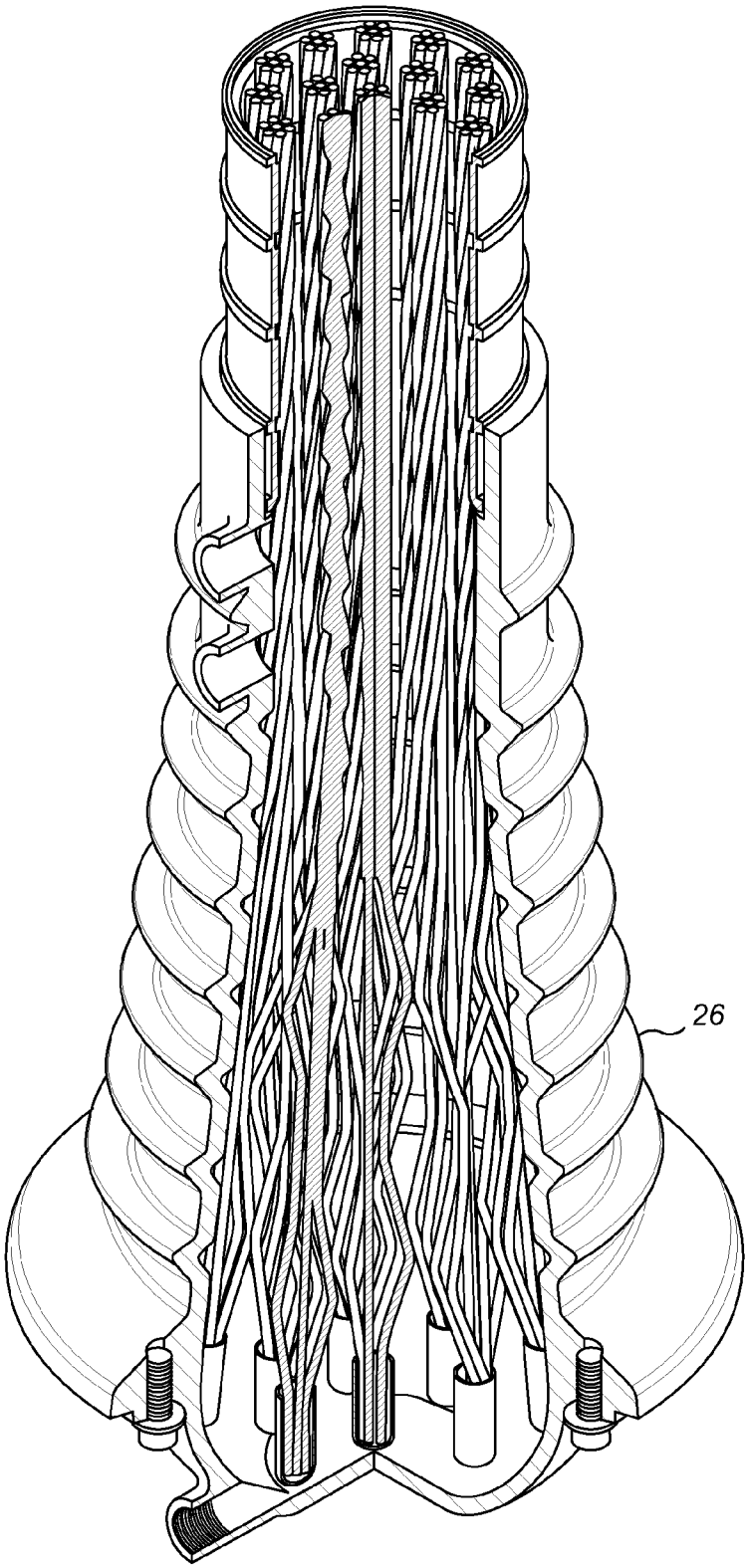

FIG. 7 is a detailed view of part D of FIG. 3;

FIG. 8 is a detailed view of part E of FIG. 3;

FIG. 9 is a plan view of a cap 12;

FIG. 10 is a section on line z-z of FIG. 8,

FIG. 11 is a view of a reinforcing tendon 14 consisting of multiple wires 15 with and without an end fitting 16 and FIG. 12 is a perspective view of the housing 10 including tendons with a part of the housing cut away.

In use one housing 10 is located at one end region of a part to be stressed such as a lower end and another housing, which may be a conventional housing, is located at another end region of a part to be stressed such as an upper end. The stressing may be effected in a horizontal direction or a vertical direction or any angle between the horizontal and vertical.

A duct (not shown), such as a tube may be connected between the spaced housings which duct may be fitted around or within the cylindrical surface 18 of each anchor. The inner or outer surface of a vent 21, may be abutted by the ends of the duct to assist in maintaining the duct in position.

Reinforcement may be placed around one or both anchors.

Concrete or another building material is then cast around the duct and around at least part of the housing 10. The concrete may extend around the outwardly located flange of the anchor housing 10 and may be flush with the outwardly facing surface of the flange or may be recessed.

Before or after casting the cap 12 of one anchor may be fastened to the flange such as by fasteners (not shown) passing through openings 22 in the cap and flange. The fasteners may be screws or bolts.

One anchor or the end face of one anchor may be inaccessible after casting. Consequently tendons 14 may be fed through the structure to reach that anchor. Before or after the concrete has cured multi-wired tendons 14 may be fed such as by being successively fed through from either side. The first tendon to be fed, when fed from the opposite side to anchor 10 may abut the inwardly facing surface 24 of the cap 12. The length of the fed tendon may be measured on the region of the anchor through which the tendon is fed. Further tendons may then be successively fed with their lengths being measured. At least one of the tendons may not extend to the inwardly facing surface 24 of the cap.

At least one and preferably all of the tendons may have at least one and preferably at least two or three or more expanded open sections 26. These open sections may be formed by individual wires of the tendons being separated by gripping the tendon at two spaced locations and pushing the grips towards each other such as by hydraulics to permanently deform the tendon such that the wires are separated. The open sections may comprise the wires in the axial direction of the tendon extending out such that the wires do not contact each other and then back from the general extend of the tendon. By including two or more open sections the depths of the anchor may be reduced by, for instance, a half of the depth of an anchor without any open sections or with only one expanded section. Consequently less grout is required to hold the tendons in place.

The open sections 26 are located in the housing. The ratio of the cross sectional area at the largest portion of the open sections relative to the cross sectional area of the regular portion of the tendon may be less than 3.5:1 or less than 3:1 or less than 2.5:1 or less than 2.25:1.

The open sections 26 of at least one tendon may be staggered from or may be alongside the open sections of at least one other tendon in the longitudinal direction. Each tendon may extend to the base of the anchor which base may be perpendicular to the extent of the tendons exiting the anchor. In this manner, if each tendon extends to the bottom, the open sections of adjacent tendons going out from the centre will be staggered slightly from each other. In an alternative embodiment the cap may be planar.

At least one of the tendons may flare out slightly from the general line of the tendon when in the housing towards the bottom of the housing.

The staggering of the open sections 26 or, alternatively or additionally, the flaring of the tendons within the housing may allow more tendons to be fed through the duct than would be the case if all of the tendons were fed simultaneously through the duct with the open sections lying side by side. The number of tendons that may be fed may be defined by the number of the cross sections of side by side tendons plus the maximum cross sectional area of one open section that can fit into the minimum gap through when the tendons are fed.

The tendons may have 7 wires per tendon with the tendons being 15 mm in diameter. 19 tendons may be used. Alternatively different wires per tendon or different number of tendons or both may be used.

The ends of the tendons may have end fittings 16 that help prevent the wires in the tendon from splaying out.

The anchoring housing containing the open sections includes hoses extending through the concrete to the vents 20. Grouting, such as high strength grout is pumped into the housing through the line at vent 28. When the housing is full of grout the grout then flows out through a vent 21. The grout may be applied before, during or after the concrete has cured.

The grout may enter the open sections and may fill those sections. When the grout has set the grout assists in retaining the tendons against movement of the tendons out of the housing. The open sections may in addition cooperate with each other to assist in preventing the tendons from leaving the housing. The internal walls of the housing extend inwardly, into the concrete. The grout cooperates with the walls of the housing which may assist in preventing the tendons held by the grout from leaving the housing.

After stressing the final grouting for the duct to be to the top face of the anchor at the other end of the structure is added from the vent 20.

The internal walls of the housing includes an irregular surface as shown in FIG. 7 which may comprise irregularities 30 which may comprise recessed which may include a surface 32 that faces towards the outside of the structure in the region of the anchor. A further surface 34 may extend from the deepest section of the surface 34 towards the outside of the structure in the region of the anchor and may so extend at an angle towards the centre line of the anchor. The irregular surface may extend around the periphery of the internal wall of the housing. There may be a plurality of irregularities spaced from each other extending around the periphery of the internal wall of the housing.

The grout may cooperate with the irregularities to assist in preventing withdrawal of the tendons from the housing.

The external walls of the housing may be of any shape or size capable of encompassing the end regions of tendons 14.

The external walls of the housing may extend generally in an inwardly tapering shape from the exterior of the structure where the anchor is located. This assists in preventing the anchor from moving inwardly by cooperation with the surrounding concrete.

In addition the external walls may include an irregular surface as shown in FIGS. 4, 5 and 6 which may comprise irregularities 36 which may comprise projections which may include a surface 38 that faces away from the exterior of the structure in the region of the anchor. A further surface 40 may extend from the widest section towards the outside of the structure in the region of the anchor and may so extend at an angle towards the centre line of the anchor. The irregular surface may extend around the periphery of the anchor. There may be a plurality of irregularities spaced from each other around the periphery of the housing.

An irregularity closer to the exterior of the structure, which may be the closest irregularity, than another irregularity may have a greater dimension than one further from the exterior of the structure. For instance the surface 38 in FIG. 4 is longer than the surface 38 shown in FIG. 6. Alternatively or additionally an irregularity further from the exterior of the structure, which may be the furthest irregularity, may have a greater dimension than one nearer the exterior of the structure. For instance the surface in FIG. 5 is longer than the surface 38 shown in FIG. 6.

The irregular surface of the exterior wall may assist in preventing inwards movement of the anchor into the structure.

After the grout in the anchor 10 and concrete has set sufficiently the tendons at the other anchor, which may be a conventional stressing anchor, can be stressed. Under stress the ends of the tendons in the anchor 10 are held in place by grout, as previously described. The ends of the tendons, after stressing at the anchor opposed to the anchor 10 may be cut off and held in place such as by the use of wedges on the cut ends of the tendons being forced into openings in an anchor head.

In an alternative arrangement (not shown) any of the above described expanded sections may be used without the anchor 10. In this embodiment the adjacent tendons and in which adjacent tendons may contact each other the expanded section or sections may be fed through a duct from the opposite side of the structure to where the anchor 10 has previously been located with concrete then being directly cast around the expanded sections of the tendons at the duct. Alternatively the tendons can be fed through the duct from the side where the anchor 10 has previously been located. In this arrangement more tendons may be employed and the duct may contain the maximum number of tendons as no expanded sections are fed through the duct. Concrete is then directly cast around the expanded sections and the duct. Stressing is then applied, after the concrete has cured, from the opposite side of the structure.

The device and method of the present disclosure may be further defined as set out in the following paragraphs.

An anchor arrangement may include a hollow anchor arranged, in use, to be located to a first side of a structure and a plurality of multi-wired tendons in which adjacent wires of each tendon are in contact with each other along the majority of the extent of the tendons, and in which one region of the tendons is arranged, in use, to be located in the hollow anchor, at least some of the said regions of the tendons including at least one expanded section in which the wires over a length of a tendon are separated from each other such that they do not contact each other characterised in that, in use, the tendons are arranged, in use, to be inserted into the hollow anchor to locate the expanded sections in the hollow anchor from a second side of a structure opposed to the first side.

At least some of the tendons may include a plurality of spaced expanded sections arranged, in use, to be located in the hollow anchor.

Each expanded section, at its maximum cross-section, may be less than the cross section of the minimum gap which the tendons must pass to reach the interior of the hollow anchor.

The ratio of the cross sectional area of the expanded section at its maximum cross section relative to the cross sectional area of the regular tendon may be less than 3.5:1 or less than 3:1 or less than 2.5:1 or less than 2.25:1.

The expanded section of adjacent tendons, when located in the anchor, may be arranged to cooperate with each other to assist in resisting any force attempting to withdraw the tendons out of the anchor in a direction towards the second side of the structure.

At least one tendon may be caused to be deflected from its general elongate extent outside of the anchor within the anchor.

Different tendons may extend to different depths within the anchor.

Different tendons may extend to the same depths within the anchor.

At least one tendon with an expanded section may include an end fitting arranged to constrain the ends of the wires of the tendon to remain in contact with each other.

The tendons within the anchor may be arranged to be held in place by grout inserted into the hollow anchor with the anchor including irregularities on its interior surface arranged to cooperate with the grout to assist in retaining the tendons in the anchor.

The irregularities may comprise recesses.

The irregularities may include at least one surface facing at least partially towards the first side.

The irregularities may include a further surface extending from the outermost part of the surface that faces the first side towards a line extending from the second side through the centre of the anchor.

The irregularities may extend around the periphery of the anchor.

The interior of the hollow anchor may taper inwardly from the first side towards the second side.

At least some of said end regions of the tendons may include an expanded region nearest the end of the tendon which is spaced from the end of the tendon.

At least some expanded sections, when located in the anchor, may overlap each other in the elongate extent of the tendons but are not coincident with each other.

A structure may include a hollow anchor as herein described.

A method of forming an anchorage may comprise locating a hollow anchor at a first side of a structure and inserting a plurality of multi-wired tendons through the structure from a second side of the structure opposed to the first side such that end regions of the tendons are located in the hollow anchor, adjacent wires of the tendons being in contact with each other along the majority of the extent of the tendons and with at least some of the end regions of the tendons including at least one expanded section in which the wires over a length of the tendon are separated from each other such that they do not contact each other with the expanded sections being located in the hollow anchor.

A method as described in the preceding paragraph when using an anchorage arrangement as herein described.

The method may comprise securing the end regions of the tendons within the hollow anchor and stressing the tendons from the second side and securing the tendons in a stressed condition at the second side.

An anchor suitable for use in a pre-stressing concrete structure, wherein the anchor may include a hollow interior into which tendons to be pre-stressed are arranged to be inserted and secured therein by grout characterised in that the interior surface of the hollow interior includes irregularities with which, in use, the grout is arranged to cooperate to assist in retaining the tendons.

The irregularities may comprise recesses.

Irregularities may comprise a surface that faces at least partially towards what, in use, will be the side of the surface that the anchor is located in.

The irregularities may comprise a further surface that extends from the outermost part of the surface that faces the side of the surface of the anchor towards a centre line of the anchor.

The irregularities may extend around the periphery of the anchor.

The interior of the anchor may taper inwardly away from the side of a structure that the anchor is arranged, in use, to be located.

An anchor as herein described when used in an anchor arrangement as herein described or when used in a method as herein described.

An anchor arrangement may include a plurality of adjacent multi-wired tendons in which adjacent wires of each tendon are in contact with each other along the majority of the extent of the tendons at least some of said end regions of the tendons including a plurality of spaced expanded sections in which the wires over a length of a tendon are separated from each other such that they do not contact each other.

There may be included a plurality of multi-wired tendons in which at least some of said end regions of the tendons include at least three expanded sections.

At least some of said end regions of the tendons may include an expanded region nearest the end of the tendon which is spaced from the end of the tendon.

At least one tendon may be caused to be deflected from the general elongate extent of that tendon at the end region including the expanded sections.

Different tendons may extend to the same depth within the structure.

Different tendons may be are arranged, in use, to extend to the same depth within the structure.

An anchor arrangement may include a hollow anchor as herein described arranged in use to be located at a side of a structure and a plurality of multi-wired tendons in which at least some expanded sections of adjacent tendons, when located in the anchor overlap each other in the elongate extent of the tendons but are not coincident with each other.

The ratio of the cross sectional area of at least one expanded section at its maximum cross section relative to the cross sectional area of the regular tendon may be less than 3.5:1 or less than 3:1 or less than 2.5:1 or less than 2.25:1.

A hollow anchor in which the end regions of the tendons may include a plurality of spaced expanded sections are arranged, in use, to be located in the hollow anchor.

A method of forming an anchor in a structure may comprise arranging a plurality of multi-wired tendons adjacent to each other, in which the wires of each tendon are in contact with each other along the majority of the extent of the tendons with at least some of the end regions including a plurality of spaced expanded sections in which the wires over a length of each tendon are separated from each other such that they do not contact each other and then casting concrete around the end regions, allowing the concrete to cure, and then stressing the tendons from the opposite end region.

The invention claimed is:

1. An anchor arrangement, comprising:

a hollow anchor arranged, in use, to be located to a first side of a structure; and a plurality of multi-wired tendons, each of the plurality of multi-wired tendons having an end region located in the hollow anchor, wherein:

each end region has one or more first portions in which adjacent wires are in contact with each other substantially along an entire length of the one or more first portions, one or more end regions include at least one second portion in which the wires over a length of the at least one second portion are separated from each other such that the wires do not contact each other to thereby form expanded sections, at least one of the plurality of multi wired tendons with the at least one second portion formed as the expanded section includes an end fitting arranged to constrain ends of wires of the at least one of the plurality of multi-wired tendons at an end of the at least one of the plurality of multi-wired tendons in the hollow anchor to cause the ends of the wires to remain in contact with each other; and the plurality of multi-wired tendons are arranged, in use, to be inserted into the hollow anchor to locate the expanded sections of the end regions in the hollow anchor from a second side of the structure, the second side being opposed to the first side.

2. The anchor arrangement of claim 1, the end region of at least one of the plurality of multi-wired tendons including two or more discrete and spaced apart second portions as the expanded sections arranged, in use, to be located in the hollow anchor.

3. The anchor arrangement of claim 1, each expanded section having a maximum cross-section that is less than a cross section of a minimum gap through which the end regions of the tendons are passed to reach an interior of the hollow anchor.

4. The anchor arrangement of claim 1, the second portions that form the expanded sections of adjacent ones of the plurality of multi-wired tendons, when located in the-hollow anchor, being arranged to cooperate with each other to assist in resisting a force attempting to withdraw the end regions of the plurality of multi-wired tendons out of the hollow anchor in a direction towards the second side of the structure.

5. The anchor arrangement of claim 1, an end region of at least one of the plurality of multi-wired tendons being deflected from a general elongate extent outside of the hollow anchor within the hollow anchor.

6. The anchor arrangement of claim 1, different ones of the plurality of multi-wired tendons extending to different depths within the hollow anchor.

7. The anchor arrangement of claim 1, the plurality of multi-wired tendons within the hollow anchor being arranged to be held in place by grout inserted into the hollow anchor with the hollow anchor including irregularities on an interior surface, the irregularities being arranged to cooperate with the grout to retain the plurality of multi-wired tendons in the hollow anchor.

8. The anchor arrangement of claim 7, the irregularities comprising recesses including at least one first surface facing at least partially towards the first side and at least one second surface extending from an outermost part of the first surface towards a line extending from the second side through a center of the hollow anchor.

9. The anchor arrangement of claim 7, the irregularities extending around a periphery of the interior surface of the hollow anchor.

10. The anchor arrangement of claim 1, wherein the interior surface of the hollow anchor tapers inwardly from the first side towards the second side.

11. The anchor arrangement of claim 1, wherein at least some of the second portions as the expanded sections, when located in the hollow anchor overlap each with other in the elongate extent of the plurality of multi-wired tendons but are not coincident with each other.

12. The anchor arrangement of claim 1, different ones of the plurality of multi-wired tendons extending to a same depth within the hollow anchor.

13. A method of forming an anchorage, comprising:

locating a hollow anchor at a first side of a structure; and inserting a plurality of multi-wired tendons through the structure from a second side of the structure, the second side opposed to the first side, to locate end regions of the plurality of multi-wired tendons in the hollow anchor, wherein:

within the hollow anchor, adjacent wires of the end regions of each of the plurality of multi-wired tendons are in contact with each other substantially along an entire length of one or more first portions of the end regions, one or more of the end regions includes at least one second portion in which the wires over a length of the at least one second portion are separated from each other such that they do not contact each other to thereby form expanded sections, and at least one of the plurality of multi-wired tendons with the at least second portion formed as the expanded section includes an end fitting arranged to constrain ends of the wires of the at least one of the plurality of multi-wired tendons to remain in contact with each other.

14. The method of claim 13, further comprising securing the end regions of the plurality of multi-wired tendons within the hollow anchor and stressing the plurality of multi-wired tendons from the second side and securing the plurality of multi-wired tendons in a stressed condition at the second side.

* * * * *